US011105331B2

(12) United States Patent
Liu et al.

(10) Patent No.: US 11,105,331 B2
(45) Date of Patent: Aug. 31, 2021

(54) CYLINDER, PUMP BODY ASSEMBLY, COMPRESSOR, AND TEMPERATURE ADJUSTING DEVICE

(71) Applicant: Green Refrigeration Equipment Engineering Research Center of Zhuhai Gree Co., Ltd., Guangdong (CN)

(72) Inventors: Xixing Liu, Guangdong (CN); Shebing Liang, Guangdong (CN); Jia Xu, Guangdong (CN); Guomang Yang, Guangdong (CN)

(73) Assignee: Green Refrigeration Equipment Engineering Research Center of Zhuhai Gree Co., Ltd, Zhuhai (CN)

( * ) Notice: Subject to any disclaimer, the term of this patent is extended or adjusted under 35 U.S.C. 154(b) by 175 days.

(21) Appl. No.: 16/335,919

(22) PCT Filed: Nov. 2, 2017

(86) PCT No.: PCT/CN2017/109044
§ 371 (c)(1),
(2) Date: Mar. 22, 2019

(87) PCT Pub. No.: WO2018/103476
PCT Pub. Date: Jun. 14, 2018

(65) Prior Publication Data

US 2019/0309751 A1 Oct. 10, 2019

(30) Foreign Application Priority Data

Dec. 5, 2016 (CN) ..... 201611107744.9
Jan. 3, 2017 (CN) ..... 201710002078.0

(51) Int. Cl.
*F25B 1/10* (2006.01)
*F04C 11/00* (2006.01)
(Continued)

(52) U.S. Cl.
CPC ..... *F04C 18/356* (2013.01); *F04C 23/00* (2013.01); *F04C 29/00* (2013.01);
(Continued)

(58) Field of Classification Search
CPC ..... F04C 18/356; F04C 18/3564; F04C 18/3562; F04C 23/00; F04C 29/00;
(Continued)

(56) References Cited

U.S. PATENT DOCUMENTS 6,799,956 B1 * 10/2004 Yap ..... F04C 23/001 29/888.025
2010/0089092 A1 * 4/2010 Hasegawa ..... F01C 21/007 62/498
2012/0201685 A1 * 8/2012 Merrill ..... F01D 9/044 416/220 R
2013/0171017 A1 * 7/2013 Park ..... F04C 18/0207 418/55.5

FOREIGN PATENT DOCUMENTS

CN 2260905 8/1997
CN 201347861 11/2009
(Continued)

*Primary Examiner* — Deming Wan
(74) *Attorney, Agent, or Firm* — Stephen Y. Liu; James R. Gourley; Carstens & Cahoon, LLP

(57) ABSTRACT

Disclosed are a cylinder, a pump body assembly, a compressor, and a temperature adjusting device. The cylinder includes a cylinder body, and a first cavity and a second cavity are formed in an axial direction of the cylinder body, wherein the first cavity is in communication with the second cavity, and an inner diameter of the first cavity is greater than that of the second cavity; and when the cylinder body operates, the first cavity forms a first working cavity, and the second cavity forms a second working cavity. With such an arrangement, multiple working cavities are formed inside one cylinder body, which simplifies an installation process of the pump body assembly, and enables a pump body with
(Continued)

the cylinder to be installed more conveniently and easily, thereby improving installation reliability of the pump body assembly.

19 Claims, 16 Drawing Sheets

(51) Int. Cl.
*F04C 23/00* (2006.01)
*F04C 18/356* (2006.01)
*F04C 29/00* (2006.01)

(52) U.S. Cl.
CPC ..... *F04C 29/0042* (2013.01); *F04C 23/008* (2013.01); *F04C 2240/30* (2013.01); *F04C 2240/60* (2013.01); *F04C 2240/80* (2013.01)

(58) Field of Classification Search
CPC .. F04C 29/0042; F04C 23/001; F04C 23/008; F04C 11/001; F01C 21/0845; F25B 1/10
See application file for complete search history.

(56) References Cited

FOREIGN PATENT DOCUMENTS

| | | |
|---|---|---|
| CN | 101761481 | 6/2010 |
| CN | 102094823 | 6/2011 |
| CN | 202203117 | 4/2012 |
| CN | 203321828 | 12/2013 |
| CN | 103511266 | 1/2014 |
| CN | 104214099 | 12/2014 |
| CN | 105392995 | 3/2016 |
| CN | 105545752 | 5/2016 |
| CN | 106523363 | 3/2017 |
| CN | 106762643 | 5/2017 |
| CN | 206221252 | 6/2017 |
| CN | 206386268 | 8/2017 |
| JP | 3222887 | 10/1991 |
| JP | 2011157921 | 8/2011 |
| WO | 2011148453 | 7/2013 |

* cited by examiner

CYLINDER, PUMP BODY ASSEMBLY, COMPRESSOR, AND TEMPERATURE ADJUSTING DEVICE

CROSS-REFERENCE TO RELATED APPLICATIONS

This application is a US 371 Application from PCT/CN2017/109044 filed Nov. 2, 2017, which claims priority to Chinese Application No. 201611107744.9 filed Dec. 5, 2016 and Chinese Application No. 201710002078.0 filed Jan. 3, 2017, the technical disclosures of which are hereby incorporated herein by reference.

TECHNICAL FIELD

The present invention relates to the technical field of compressor, and more particularly, to a cylinder, a pump body assembly, a compressor and a temperature adjusting device.

BACKGROUND

In the prior art, the structure of the double-cylinder compressor can be classified as a separate compression double-cylinder structure, a double-stage compression structure or a double-stage enthalpy-adding structure. Wherein, the separate compression double-cylinder structure can obtain a larger refrigerating capacity; the single-stage compression ratio of the double-stage compression structure is significantly reduced; and the double-stage enthalpy-adding structure can effectively improve the performance in a low-temperature environment and broaden the operating range of the compressor. Based on the above advantages, the double-cylinder compressor is widely used. Further, the assembly process of the double-cylinder compressor in the prior art is complicated, and it includes centering twice and center-coinciding once, which not only requires long assembling time, but also easily causes the pump body to be jammed.

SUMMARY OF THE INVENTION

The main objective of the present invention is to provide a cylinder, a pump body assembly, a compressor and a temperature adjusting device, so as to solve the problem of complicated assembly process of the compressor pump body structure of in the prior art.

In order to realize the objective above, according to one aspect of the present invention, a cylinder is provided. The cylinder includes a cylinder body; a first cavity and a second cavity are formed along an axial direction of the cylinder body; the first cavity is in communication with the second cavity; an inner diameter of the first cavity is greater than an inner diameter of the second cavity; and when the cylinder body is in operation, the first cavity forms a first working cavity, and the second cavity forms a second working cavity.

Further, the first cavity and the second cavity are arranged coaxially, and an inner wall of the second cavity disposed above the first cavity forms a stopping portion.

According to another aspect of the present invention, a pump body assembly, including the cylinder defined above, is provided.

Further, the pump body assembly includes: a rotating shaft, wherein the rotating shaft is provided with a first eccentric portion and a second eccentric portion; the first eccentric portion is disposed in the first cavity of the cylinder body, and the second eccentric portion is disposed in the second cavity of the cylinder body; and a baffle, wherein the baffle is arranged on the rotating shaft, and is disposed between the first eccentric portion and the second eccentric portion and in the first cavity; and the baffle is configured to isolate the first cavity from the second cavity.

Further, the baffle and the rotating shaft are integrally provided.

Further, the baffle includes: a first plate body, which has a first curved recess, and a receiving groove is provided in the first plate body; and a second plate body, which has a second curved recess; wherein a connecting convex portion is formed at a side of the second plate body facing the first plate body; the second plate body engages with the first plate body; a shaft opening is formed by the first curved recess and the second curved recess to receive the rotating shaft body; and the connecting convex portion is inserted into and engages with the receiving groove.

Further, the pump body assembly includes a first roller, which is disposed in the first cavity and sleeved on the first eccentric portion; and a second roller, which is disposed in the second cavity and sleeved on the second eccentric portion.

Further, a first sliding vane groove is disposed on a cavity wall of the first cavity; and a height of the first sliding vane groove is identical with a height of the first roller.

Further, a second sliding vane groove is disposed on a cavity wall of the second cavity; and a height of the second sliding vane groove is identical with a height of the second cavity.

Further, a first gas inlet and a first gas outlet, which are in communication with the first cavity, are disposed in a cavity wall of the first cavity; and a second gas inlet and a second gas outlet, which are in communication with the second cavity, are disposed in the cylinder body.

Further, a first gas inlet and a first gas outlet, which are in communication with the first cavity, are disposed in a cavity wall of the first cavity; and a second gas inlet and a second gas outlet, which are in communication with the second cavity, are disposed in an end surface of the cylinder body; the second gas inlet is disposed in a cavity wall of the second cavity; and the second gas inlet is in communication with the first gas outlet.

Further, an overflow passage is provided in the cylinder body; and the second gas inlet is connected to the first gas outlet through the overflow passage.

According to another aspect of the present invention, a compressor is provided; the compressor includes the cylinder above.

According to the technical schemes of the present invention, the cylinder includes the cylinder body. The first cavity and the second cavity are formed along the axial direction of the cylinder body; the first cavity is in communication with the second cavity; the inner diameter of the first cavity is greater than the inner diameter of the second cavity; and when the cylinder body is in operation, the first cavity forms the first working cavity, and the second cavity forms the second working cavity. In this way, a plurality of working cavities are formed inside one cylinder, which effectively simplifies the installation process of the pump body assembly, and enables the pump body assembly having the cylinder to be installed more conveniently and easily, thereby improving the installation reliability of the pump body assembly.

BRIEF DESCRIPTION OF THE DRAWINGS

The accompanying drawings constituting a part of the present application are provided to further make the present invention understood. The illustrative embodiments of the present invention and the description are used to explain the present invention, but not intended to limit the present invention. In the drawings.

Figure 1:
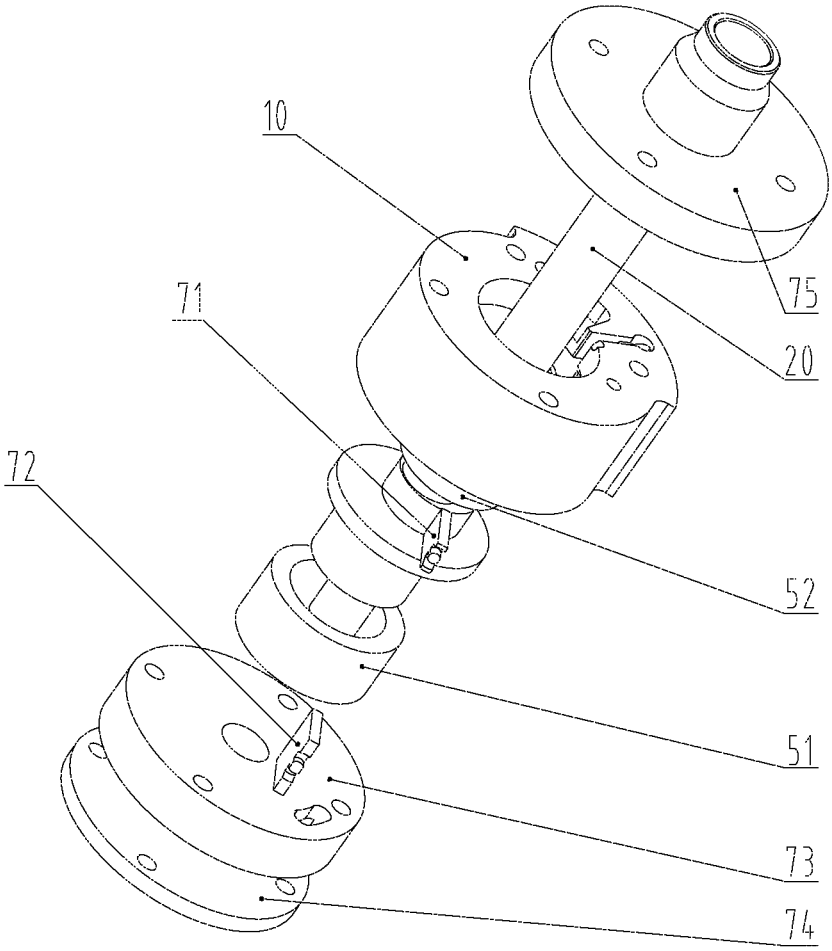
FIG. 1 is a schematic exploded view illustrating the pump body assembly according to an embodiment of the present invention.

Wherein, the above figures include the following reference numerals:

2 cylinder; 3 the partition pin;

10 cylinder body; 11 first cavity; 12 second cavity; 121 stopping portion; 122 partition pin opening; 13 upper sliding vane groove; 14 lower sliding vane groove; 15 flat face; 16. back pressure groove;

20 rotating shaft; 21 first eccentric portion; 22 second eccentric portion; 30 baffle; 31 first plate body; 311 first curved recess; 312 receiving groove; 32 second plate body; 321 second curved recess; 322 connecting convex portion; 40 shaft opening; 51 first roller; 52 second roller; 60 overflow passage; 71 sliding vane; 72 sliding vane; 73 lower flange; 74 cover plate; 75 upper flange.

DETAILED DESCRIPTION OF THE PREFERRED EMBODIMENTS

It should be specified that, the embodiments and the features in the embodiments of the present application may be combined with each other when there is no conflict. The embodiments of present invention will be described in detail with reference to the accompanying drawings.

It should be noted that, the terminology herein is used for describing the specific embodiments, but not intended to limit the illustrative embodiments of the present application. The singular terms herein are intended to include their plural unless specific descriptions are provided in context. It should be also understood that, the terms "include" and/or "comprise" in the description refer to including the features, steps, operations, devices, components, and/or combinations thereof.

It should be specified that the terms "first", "second", etc. in the description, the claims and the drawings in the present application are just used to distinguish similar objects, but not used to describe a specific order or an order of priority. It should be understood that such terms may be interchangeable under appropriate conditions, such that the embodiments of the present application illustrated in the drawing or described herein can be implemented, for example, in a sequence other than the sequences illustrated or described herein. In addition, the terms "comprise", "have" and any variations thereof are intended to cover a non-exclusive inclusion. For example, a process, a method, a system, a product, or a device that includes a series of steps or units is not limited to those steps or units listed clearly, but may include other steps or units, which are not clearly listed, or which are inherent to such a process, a method, a product or a device.

For the convenience of description, terms of spatial relations such as "above", "over", "on a top surface", "upper", etc., may be used herein to describe the spatial position relationships of a device or a feature with other devices or features shown in the drawings. It should be understood that the terms of spatial relations are intended to include other different orientations in use or operation in addition to the orientation of the device described in the drawings. For example, if the device in the drawings is placed upside down, the device described as "above other devices or structures" or "over other devices or structures" will be positioned as "below other devices or structures" or "under other devices or structures". Thus, the exemplary term "above" may include both "above" and "below". The device can also be positioned in other different ways (rotating 90 degrees or at other orientations), and the corresponding explanations for the description of the spatial relations will be provided herein.

Now exemplary embodiments of the present application will be described in detail with reference to the accompanying drawings. However, the exemplary embodiments may be implemented in different forms and should not be interpreted to limit the present application. It should be understood that the embodiments are provided so that the disclosure of the present application will be thorough and complete, and the concepts of the exemplary embodiments will be sufficiently disclosed to those skilled in the art. In the drawings, the thicknesses of the layers and regions may be enlarged for the sake of clarity, and as the same reference numerals denote the identical devices, the description thereof is omitted.

As shown in FIGS. 1 through 14, according to an embodiment of the present invention, a cylinder is provided.

Specifically, as shown in FIGS. 1 through 7, the cylinder includes a cylinder body 10. A first cavity 11 and a second cavity 12 are formed along the axial direction of the cylinder body 10. The first cavity 11 is in communication with the second cavity 12, and the inner diameter of the first cavity 11 is greater than the inner diameter of the second cavity 12. When the cylinder body 10 is in operation, the first cavity 11 forms a first working cavity, and the second cavity 12 forms a second working cavity.

In this embodiment, a plurality of working cavities are formed inside one cylinder, which can effectively simplify the installation process of the pump body assembly, and enables the pump body having the cylinder to be installed more conveniently and easily, thereby improving installation reliability of the pump body assembly.

Figure 6:
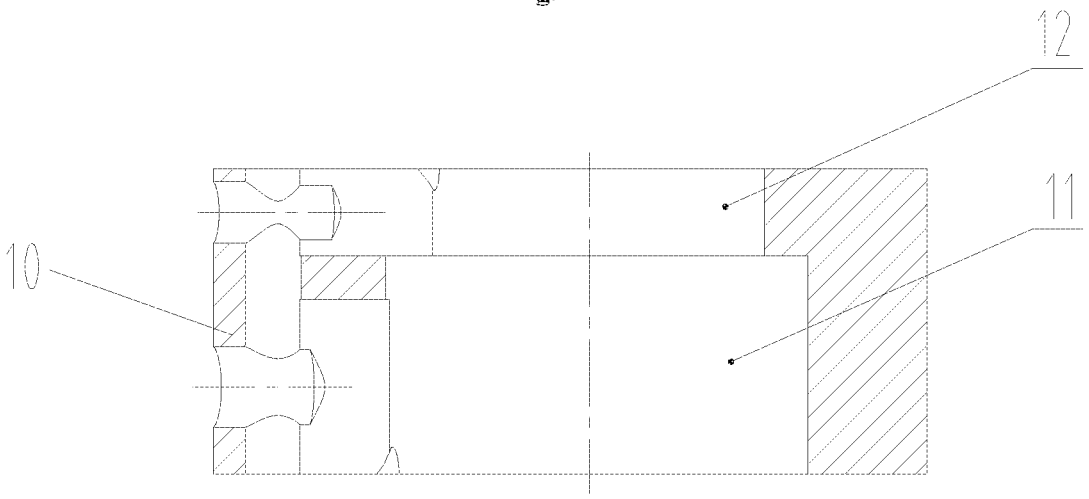
FIG. 6 is a cross-sectional structural view illustrating the cylinder in FIG. 5 along the direction A-A.
Figure 7:
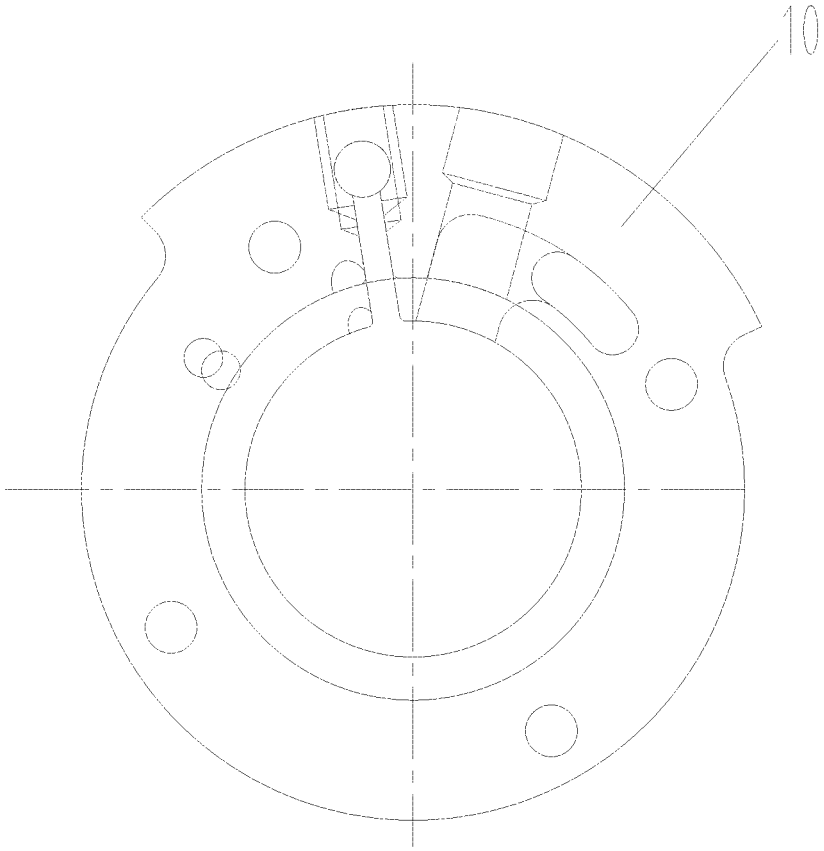
FIG. 7 is a schematic structural view illustrating the lower end surface of the cylinder in FIG. 4.

In order to improve the performances of the cylinder, the first cavity 11 and the second cavity 12 are arranged coaxially, and the inner wall of the second cavity 12 above the first cavity 11 forms a stopping portion 121. As shown in FIG. 6, the first cavity 11 and the second cavity 12 are connected and disposed through the entire cylinder body. The inner diameter of the first cavity 11 is greater than the inner diameter of the second cavity 12, therefore, a stopping step having a stopping function, namely the stopping portion 121, is formed at the joint where the first cavity 11 and the second cavity 12 are connected. In this way, the first cavity 11 and the second cavity 12 can be isolated by a baffle lapped with the stopping portion 121, to form closed working cavities. Since the cross sections of the first cavity 11 and the second cavity 12 are round, the stopping portion 121 is actually an annular structure formed above the first cavity 11.

The cylinder above can be applied in the field of a pump body assembly, i.e., according to another aspect of the present invention, a pump body assembly is provided. The pump body assembly includes a cylinder, which is the one in the above embodiment.

Specifically, the pump body assembly includes a rotating shaft 20 and a baffle 30. The rotating shaft 20 is provided with a first eccentric portion 21 and a second eccentric portion 22. The first eccentric portion 21 is disposed in the first cavity 11 of the cylinder body 10, and the second eccentric portion 22 is disposed in the second cavity 12 of the cylinder body 10. The baffle 30 is arranged on the rotating shaft 20, and is disposed between the first eccentric portion 21 and the second eccentric portion 22 and located in the first cavity 11. The baffle 30 isolates the first cavity 11 from the second cavity 12. In this way, the baffle 30 arranged on the rotating shaft 20 isolates the first cavity 11 from the second cavity 12 to form two working cavities having compression functions, thereby effectively reducing the processing difficulty and the assembling difficulty of the cylinder, increasing the assembling accuracy of the pump body assembly and improving the working performances of the pump body assembly.

Figure 8:
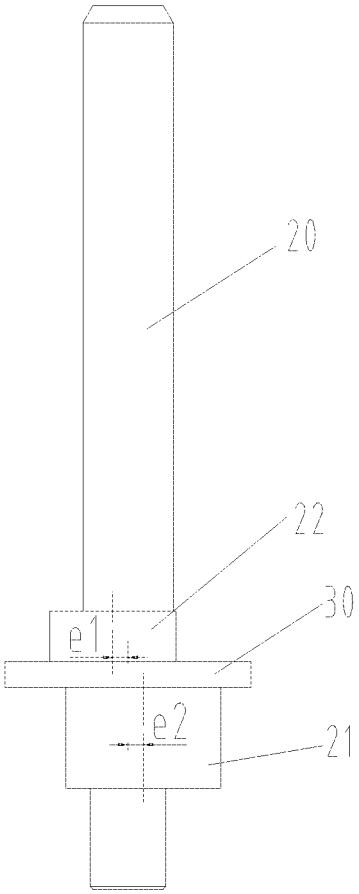
FIG. 8 is a schematic structural view illustrating an embodiment of the rotating shaft in FIG. 1.
Figure 9:
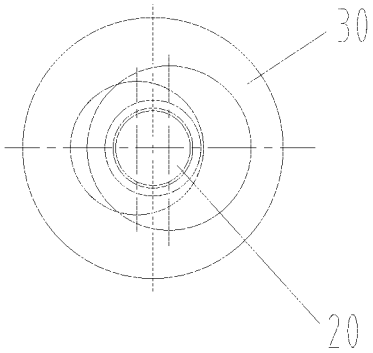
FIG. 9 is a schematic structural view illustrating the embodiment of the rotating shaft in FIG. 8 from another perspective.
Figure 10:
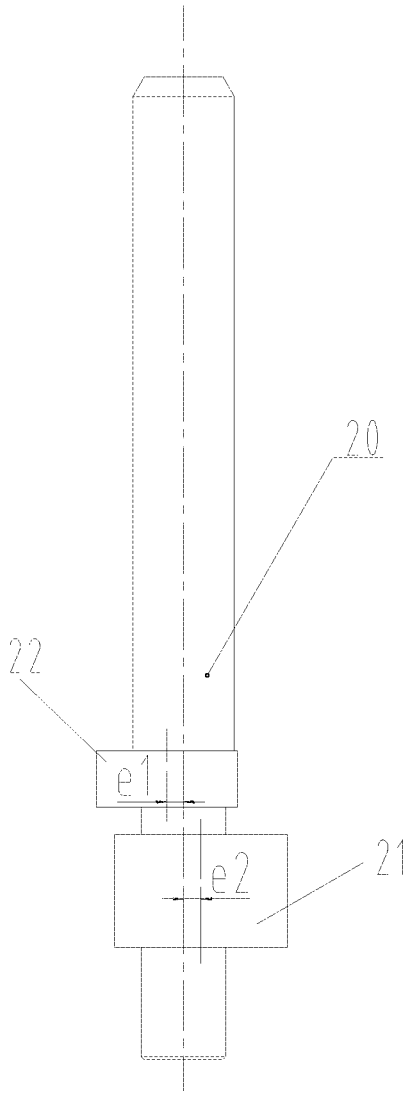
FIG. 10 is a schematic structural view illustrating another embodiment of the rotating shaft in FIG. 1.
Figure 11:
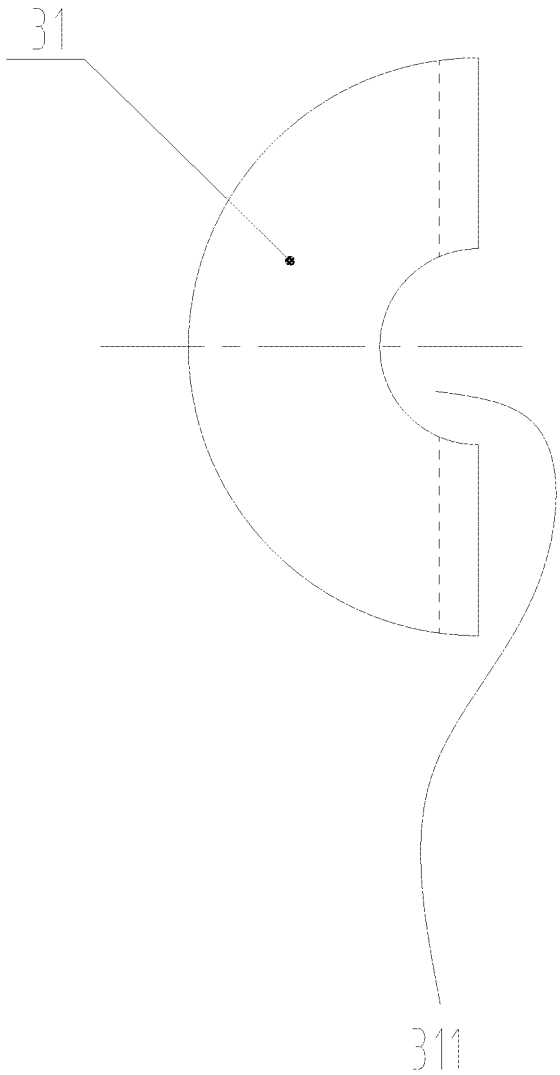
FIG. 11 is a schematic structural view illustrating an embodiment of the first plate body in FIG. 1.
Figure 12:
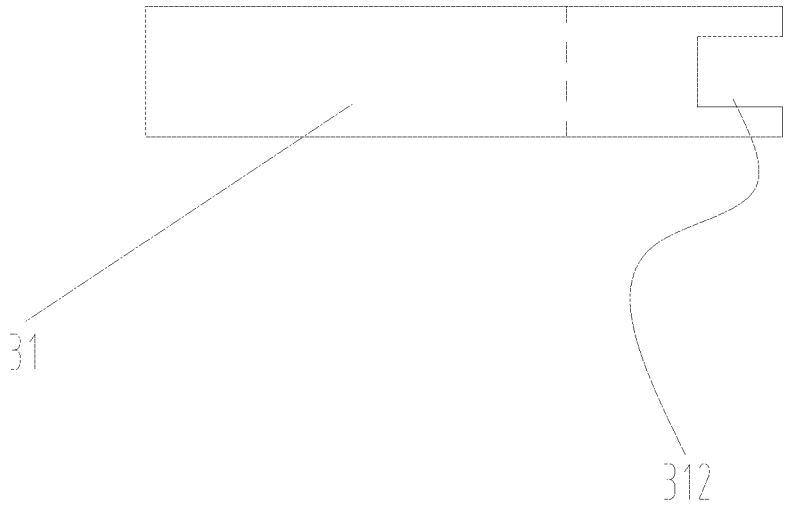
FIG. 12 is a schematic structural view illustrating the embodiment of the first plate body in FIG. 11 from another perspective.
Figure 13:
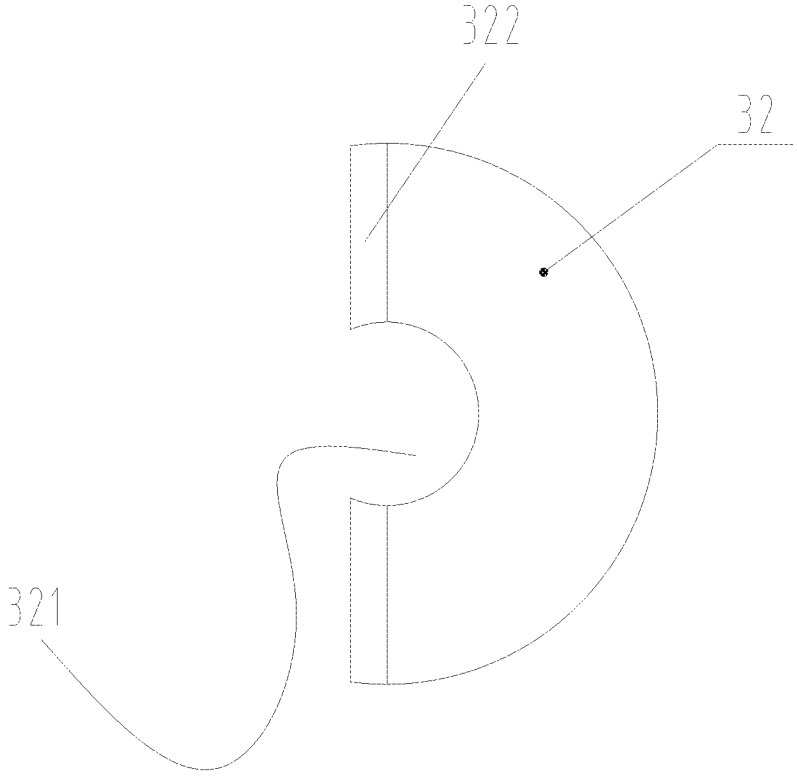
FIG. 13 is a schematic structural view illustrating an embodiment of the second plate body in FIG. 1.
Figure 14:
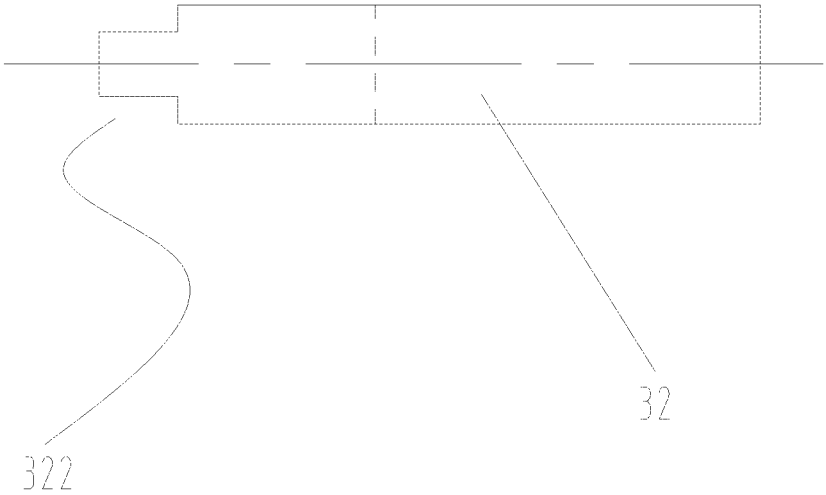
FIG. 14 is a schematic structural view illustrating the embodiment of the second plate body in FIG. 13 from another perspective.
Figure 15:
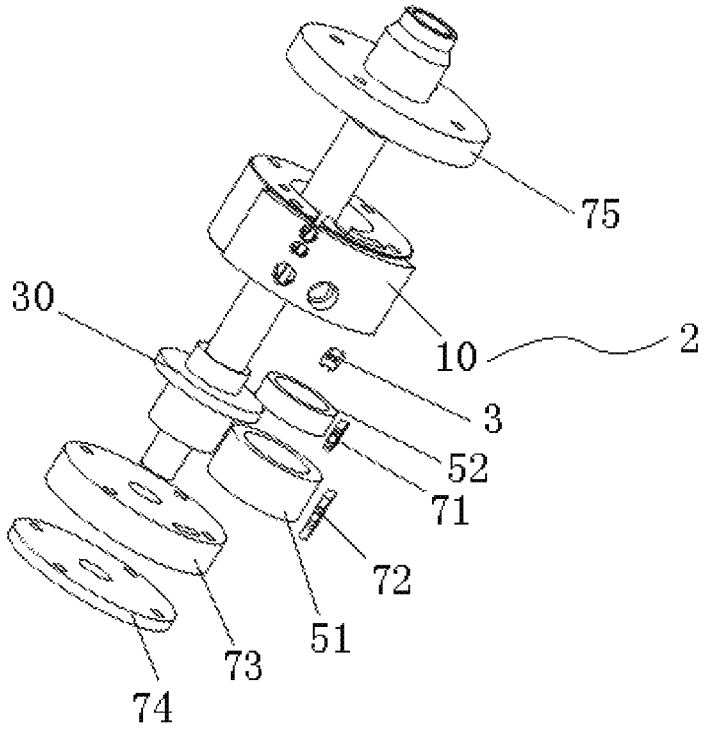
FIG. 15 is a schematic exploded view illustrating another embodiment of the pump body assembly of the present invention.

Preferably, as shown in FIG. 8, the baffle 30 and the rotating shaft 20 are integrally provided. In this way, the baffle 30 can rotate in synchronization with the rotating shaft, and effectively isolate the first cavity 11 from the second cavity 12, thereby effectively improving the tightness between the first cavity 11 and the second cavity 12.

Of course, in this embodiment, the baffle 30 may also be a baffle structure including a first plate body 31 and a second plate body 32. As shown in FIGS. 11 through 14, the first plate body 31 has a first curved recess 311 and a receiving groove 312. The second plate body 32 has a second curved recess 321, and a connecting convex portion 322 is formed at a side of the second plate body 32 facing the first plate body 31. The second plate body 32 engages with the first plate body 31; a shaft opening 40 is formed by the first curved recess 311 and the second curved recess 321 to receive the rotating shaft body; and the connecting convex portion 322 is inserted into and engages with the receiving groove 312. That is, the baffle is provided in an unfixed manner, and it is fixed at an axial position under the action of the upper end surface of the first compression cavity (namely the first cavity 11). In this case, driven by the roller, the baffle 30 can rotate on its axis at a certain speed, which can reduce the autorotation speed of the upper and lower rollers, thereby reducing the friction loss between the rollers, the baffle 30 and the eccentric portions of the shaft. Wherein, the baffle may be fixed by screwing from the upper flange. In this embodiment, the baffle 30 takes the same effect as the baffle in the existing multi-cylinder compressor.

Figure 2:
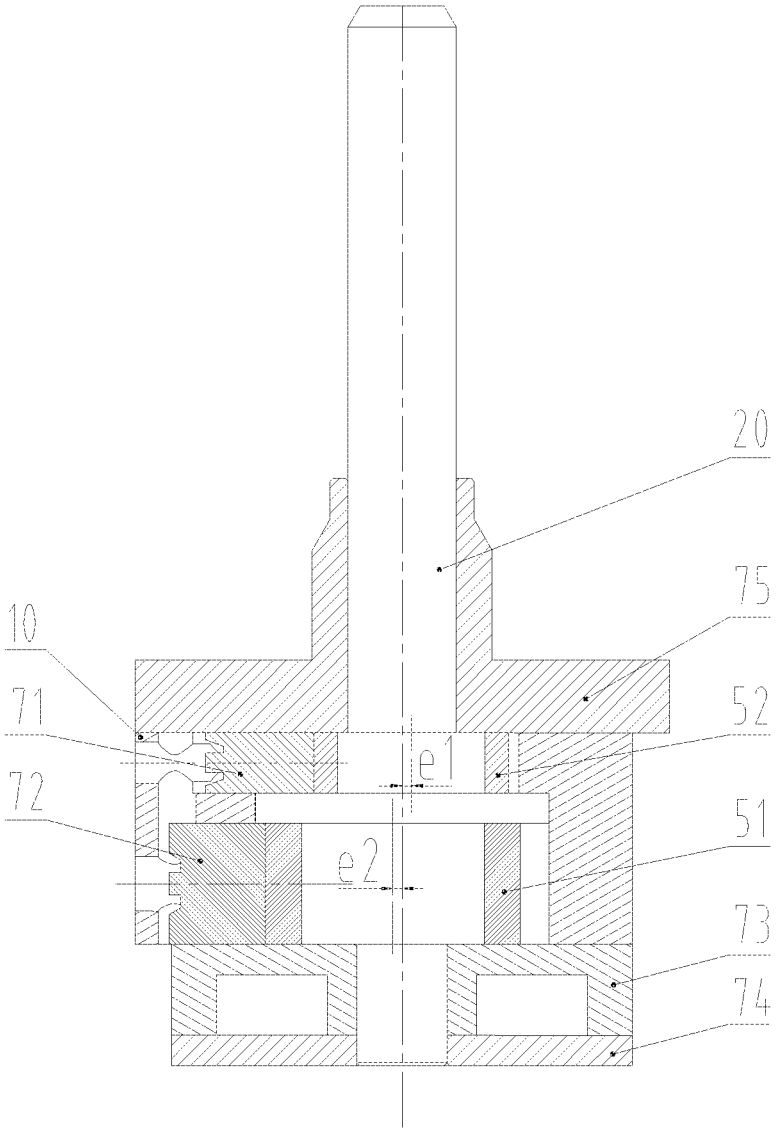
FIG. 2 is a cross-sectional view illustrating an embodiment of the pump body assembly in FIG. 1.

Further, the pump body assembly includes a first roller 51 and a second roller 52. The first roller 51 is disposed in the first cavity 11 and sleeved on the first eccentric portion 21. The second roller 52 is disposed in the second cavity 12 and sleeved on the second eccentric portion 22. The baffle is fixed at an axial position under the actions of the lower roller (namely the first roller 51) and the upper end surface of the first compression cavity. In this case, driven by the roller, the baffle can rotate on its axis at a certain speed, which can reduce the autorotation speed of the upper and lower rollers, thereby reducing the friction loss between the rollers, the baffle and the eccentric portions of the crankshaft. As shown in FIG. 2, the eccentricities of the first eccentric portion 21 and the second eccentric portion 22 relative to the crankshaft are e1 and e2 respectively.

To ensure that no blowby is generated between the first cavity 11 and the second cavity 12, the height of the first sliding vane groove disposed on the cavity wall of the first cavity 11 is identical with the height of the first roller 51, and the height of the second sliding vane groove disposed on the cavity wall of the second cavity 12 is identical with the height of the second cavity 12.

Further, a first gas inlet and a first gas outlet, which are in communication with the first cavity 11, are disposed in the cavity wall of the first cavity 11; and a second gas inlet and a second gas outlet, which are in communication with the second cavity 12, are disposed in the cylinder body 10. That is to say, the cylinder body 10 is provided with gas inlets and gas outlets which are in communication with the first cavity 11 and the second cavity 12 respectively, and such a cylinder can realize separate compression; the compressed gas is discharged into the compressor housing, and after being treated with sound deadening, the gas is discharged out of the compressor housing. That is to say, the two-stage compression cavity is provided with the gas inlet to suck in gas separately, and position of the intermediate flow passage is offset to avoid the gas inlet of the two-stage compression cavity. Thus, the two compression cavities suck in and discharge gas separately, and the principle of the compressor is identical with the principle of a double-cylinder compressor.

Of course, the gas inlets and the gas outlets of the cylinder can also be arranged as follows: the first gas inlet and the first gas outlet, which are in communication with the first cavity 11, are disposed in the cavity wall of the first cavity 11; and the second gas inlet and the second gas outlet, which are in communication with the second cavity 12, are disposed in the end surface of the cylinder body 10. The second gas inlet is disposed in the cavity wall of the second cavity 12, and the second gas inlet is in communication with the first gas outlet. In this way, the gas compressed by the first cavity 11 is discharged into the second cavity 12 for a secondary compression, thereby effectively increasing the heating capacity of the compressor.

Figure 3:
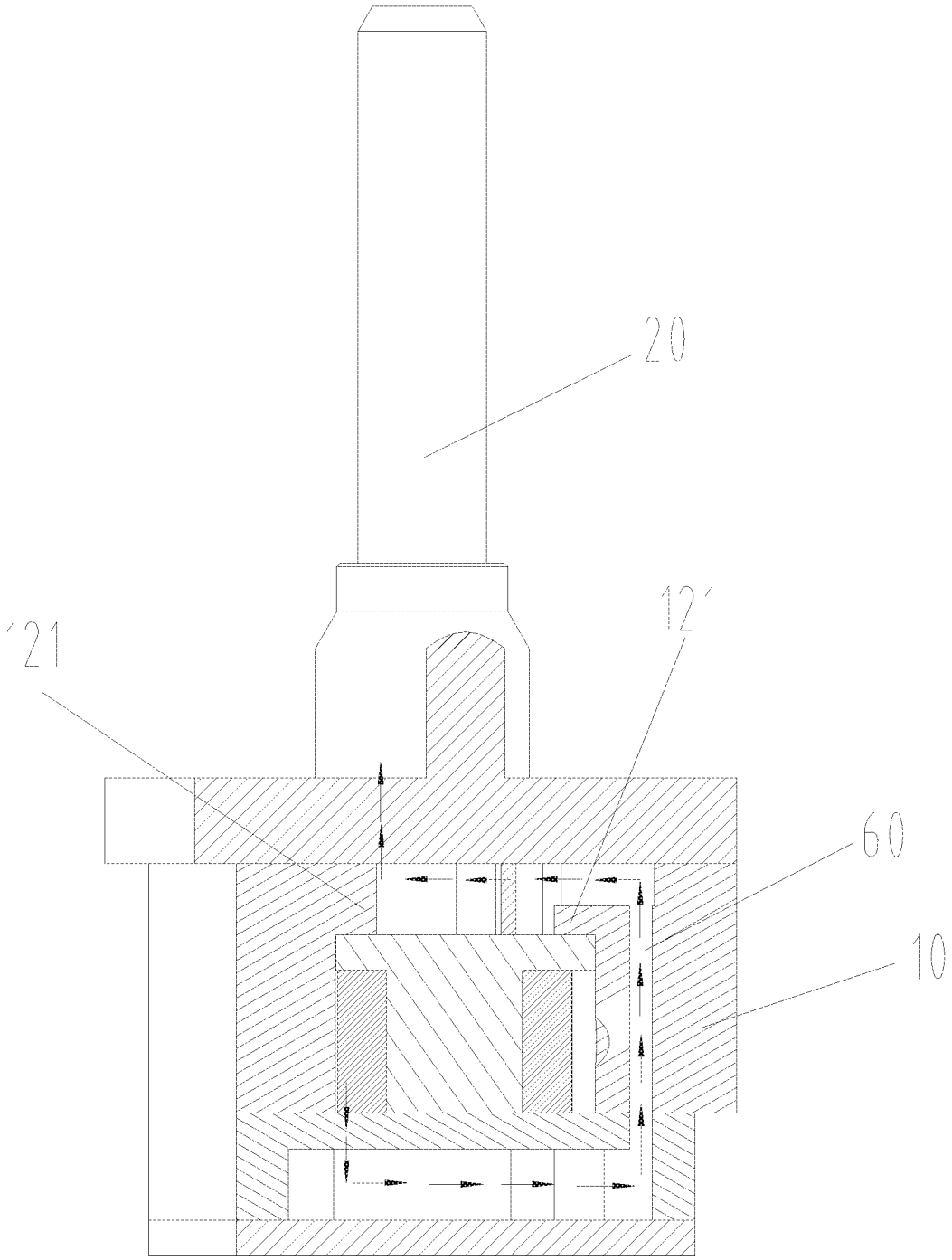
FIG. 3 is a schematic view illustrating an embodiment of the refrigerant flow path of the pump body assembly in FIG. 1.

Specifically, in order to simplify the pipeline of the refrigerant, an overflow passage 60 is provided in the cylinder body 10, and the second gas inlet is connected to the first gas outlet through the overflow passage 60. As shown in FIG. 3, a lower flange 73 is provided on the lower end surface of the cylinder body 10, and a refrigerant passage, in communication with the gas outlet of the first cavity 11 and the overflow passage 60, is disposed in the lower flange 73.

The cylinder in the embodiment above can also be applied in the technology field of compressor. According to another aspect of the present invention, a compressor is provided. The compressor includes the cylinder in the embodiment above. The cylinder includes a cylinder body 10. The first cavity 11 and the second cavity 12 are formed along the axial direction of the cylinder body 10. The first cavity 11 is in communication with the second cavity 12, and the inner diameter of the first cavity 11 is greater than the inner diameter of the second cavity 12. When the cylinder body 10 is in operation, the first cavity 11 forms the first working cavity, and the second cavity 12 forms the second working cavity. In this way, a plurality of working cavities are formed inside one cylinder, which effectively simplifies the installation process of the pump body assembly, and enables the compressor having the cylinder to be installed more conveniently and easily, thereby improving the installation reliability of the pump body assembly.

A compressor pump body assembly is provided. The upper and lower cylinders of the former double-cylinder structure are integrated into one cylinder, which includes a first-stage compression cavity and a second-stage compression cavity. The former crankshaft and the baffle are integrated into one crankshaft. The former centering process, which includes steps of fixing and centering the upper flange and the upper cylinder, fixing and centering the lower flange and the lower cylinder, and then coinciding centers of the upper cylinder and the lower cylinder, is substituted by fixing and centering the cylinder and the upper flange once.

Such a pump body assembly can reduce number of parts of the pump body but still have the advantages of the two-cylinder structure, can reduce the times of centering, and shorten the assembly time, thereby effectively avoiding jam of the pump body caused by centering twice and coinciding centers once, and improving the operational reliability of the compressor.

The compressor of this embodiment still has the advantages of the double-cylinder structure, but the assembling process of the pump body can be completed by centering once, thereby simplifying the assembling process, shortening the assembling time, effectively avoiding jam of the pump body caused by centering several times and coinciding centers once, and improving the operational reliability of the compressor.

Specifically, the cylinder structure of the compressor is processed and formed by processing the cylinder with concentric inner circles having unequal diameters, and the inner circles match with the upper eccentric portion and the lower eccentric portion of the crankshaft, so as to achieve double-stage compression.

The crankshaft of the compressor is an integrated part substituting for the baffle and the crankshaft of the former double-cylinder structure, and can reduce the relative speed of the roller and the baffle, thereby reducing the frictional power consumption of the roller and the baffle. In this embodiment, the baffle 30 of the crankshaft and the stopping portion 121 form a large face seal, which can effectively avoid leakage between the high-pressure cavity and the low-pressure cavity.

Figure 4:
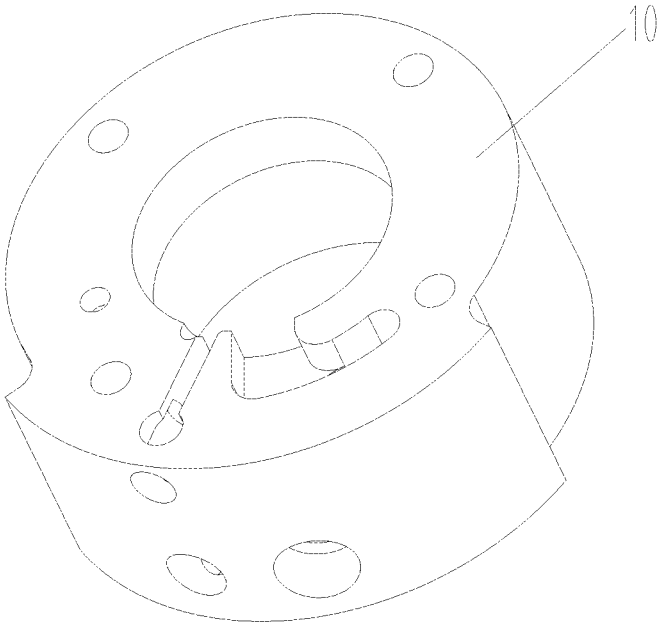
FIG. 4 is a schematic perspective view illustrating an embodiment of the cylinder in FIG. 1.

FIG. 1 is an exploded view illustrating the compressor pump body assembly, which, compared with the double-stage compressor in the market, has fewer parts. FIG. 2 is a view illustrating the compressor pump body assembly, which, compared with the double-stage compressor of mass production, can fulfill the assembly of the pump body through centering once and effectively avoid jam of the pump body caused by coinciding centers of the upper cylinder and the lower cylinder. FIG. 3 is a view illustrating the gas flow path in the pump body assembly. FIG. 4 is a schematic view illustrating the cylinder of this embodiment, and two compression cavities of the cylinder are formed in one part; the gas discharged out of the first-stage compression cavity flows into the second-stage compression cavity through the intermediate flow passage. As for the rotating shaft structure of this embodiment, namely the crankshaft, the rotation of the baffle portion of the crankshaft makes the relative speed of the roller and the baffle portion of the crankshaft decrease, thereby reducing the friction loss of the movement of the roller. In an alternative scheme of the crankshaft, the baffle is driven to rotate by the rotation of the roller, which can also reduce the angular velocity of rotation of the roller, thereby reducing friction loss.

Specifically, the pump body assembly includes: a cylinder which has a first-stage compression cavity namely the first cavity 11 and a second-stage compression cavity namely the second cavity 12, a crankshaft which has two eccentric portions and a baffle structure preventing leakage between the high-pressure cavity and the low-pressure cavity, two sliding vanes (a sliding vane 71, a sliding vane 72), two rollers (a first roller 51, a second roller 52), an upper flange 75 (exhaust structure is not shown in the figure), a lower flange 73 (exhaust structure is not shown in the figure), a cover plate 74, and a plurality of screws (not shown). The assembly diagram of the pump body is shown in FIG. 2, and the assembling process is as follows: firstly connect the cylinder with the upper flange with screws to form an assembly M1; then place the upper sliding vane into the two-stage compression cavity, and place the upper roller on the eccentric portion on the crankshaft, to form the assembly M2; and then place the assembly M2 in the assembly M1; place the lower roller on the short shaft of the crankshaft; center through the first-stage compression cavity of the cylinder; fasten the screws of the upper flange; fasten the lower flange and the cover plate; and the assembly of the pump body is completed.

The gas flow path is shown in FIG. 3. After being discharged out of the first-stage compression cavity, the gas enters the intermediate cavity formed by the lower flange and the cover plate, and passes through the intermediate flow passage in the cylinder, then enters the second-stage compression cavity through the gas inlet, and finally enters the compressor housing through the gas outlet of the upper flange.

Figure 5:
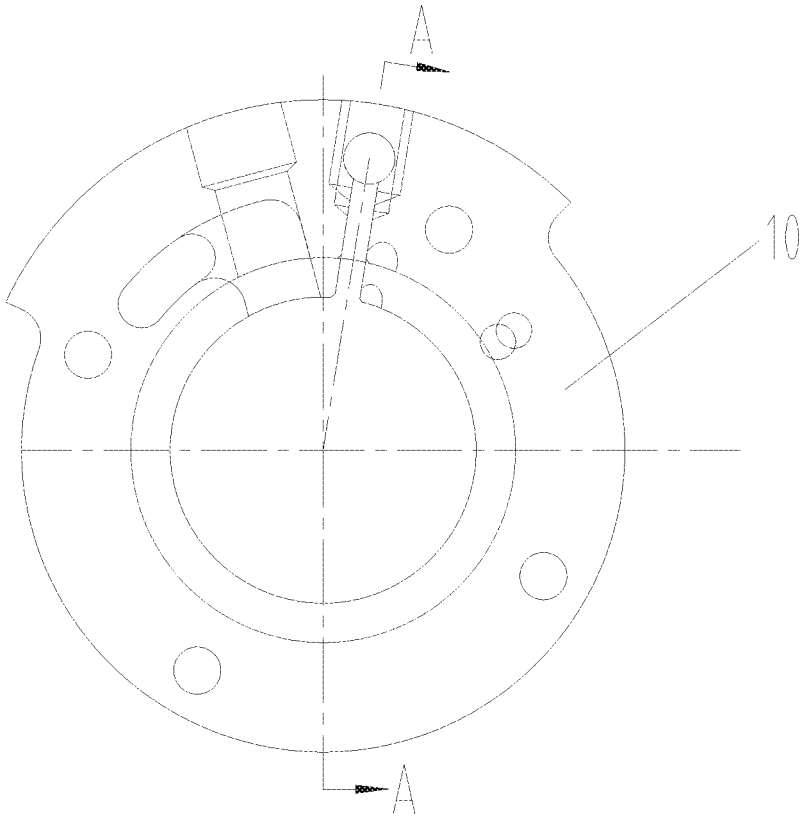
FIG. 5 is a schematic structural view illustrating an embodiment of the upper end surface of the cylinder in FIG. 4.

The structure of the cylinder is shown in FIG. 4. The inner circles of the cylinder are processed to have concentric and unequal diameters. The portion with a larger diameter is processed to be the first-stage compression cavity, the portion with a smaller diameter is processed to be the second-stage compression cavity; and the portion with a smaller diameter is provided with a sliding vane groove with a height equal to the height of the second-stage compression cavity of the cylinder. The height of the sliding vane groove in the portion with a larger diameter is ensured to engage with the lower roller. The two sliding vane grooves are not in communication, and the height of the disconnected portion is ensured to be equal to the height of the baffle portion of the crankshaft, as shown in FIG. 5, the view along the A-A direction. The gas inlet of the second-stage compression cavity of the cylinder can be processed into a rectangular structure, a U-shaped structure or a beveled cut structure. To ensure the sealing between the high-pressure cavity and the low-pressure cavity, the gas inlet of the second-stage compression cavity is processed from the upper end surface of the cylinder, but in the axial direction, the gas inlet is processed avoiding communicating with the second-stage compression cavity.

Another embodiment of the present invention provides a compressor pump body, which can effectively simplify the assembling process of a multi-cylinder compressor, shorten assembling time, and effectively avoid jam of the crankshaft.

Another objective of the present invention is to provide a compressor having the compressor pump body above.

Still another objective of the present invention is to provide a temperature adjusting device provided with the compressor above.

In order to make the schemes of the present invention better understood for those skilled in the art, the embodiments of the present invention will be further described in detail hereafter with reference to the accompanying drawings.

As shown in FIGS. 15 through 21, the compressor pump body disclosed by this embodiment includes following basic components: an upper flange 75, a lower flange 73, a cylinder 2 and a rotating shaft 20. Only one cylinder 2 is provided in the compressor pump body. A plurality of eccentric portions are disposed on the rotating shaft 20 at a segment extending into the inner cavity of the cylinder 2. In order to ensure the rotation balance during the rotation of the rotary shaft 20, dynamic-balance tests for the eccentric portions are performed. Additionally and most important of all, a baffle 30 concentric with the rotating shaft 20 is disposed between any two adjacent eccentric portions, and the baffle 30 separates the inner cavity of the cylinder 2 into working cavities in one-to-one correspondence with the eccentric portions. Wherein, the cylinder 2 is the cylinder in the embodiment above, and the plurality of working cavities include a first working cavity and a second working cavity.

It should be noted that, that the baffle 30 is concentric with the rotating shaft 20 means the baffle 30 is concentrically arranged with the rotation center of the rotating shaft 20.

The compressor pump body disclosed in the embodiment above is substantially a multi-cylinder pump body, however, the multiple cylinders in the pump body are not independent from each other, but the inner cavity of the cylinder is separated into a plurality of working cavities by the baffle 30 provided on the rotating shaft 20, and each cavity forms a conventional cylinder body. The compressor pump body not only preserves the advantages of the multi-cylinder pump body, but also, as only one cylinder housing is provided, in the assembling process, only one step of fixing and centering the cylinder and the upper flange is required, without coinciding centers several times, which can effectively avoid the accumulation of errors, and avoid vibration of the compressor and jam of the crankshaft. In addition, as for the multi-cylinder compressor pump body, the number of parts is greatly reduced, thereby shortening the assembling time and improving the assembling efficiency.

It will be easily understood by those skilled in the art that, by providing a plurality of eccentric portions on the rotating shaft 20 and providing the baffle 30 between any adjacent two eccentric portions, the inner cavity of one cylinder 2 is separated into two, three or even more working cavities, each of which is provided with a sliding vane engaging with the corresponding roller, which can form a conventional two-cylinder compressor, three-cylinder compressor or multi-cylinder compressor.

As shown in FIGS. 15-19, the present invention will be described in detail by taking a vertical double-cylinder compressor as an example in the embodiment of the present invention. Of course, the technical solutions of the present invention are not limited to a vertical compressor, and not limited to a double-cylinder compressor either.

Figure 16:
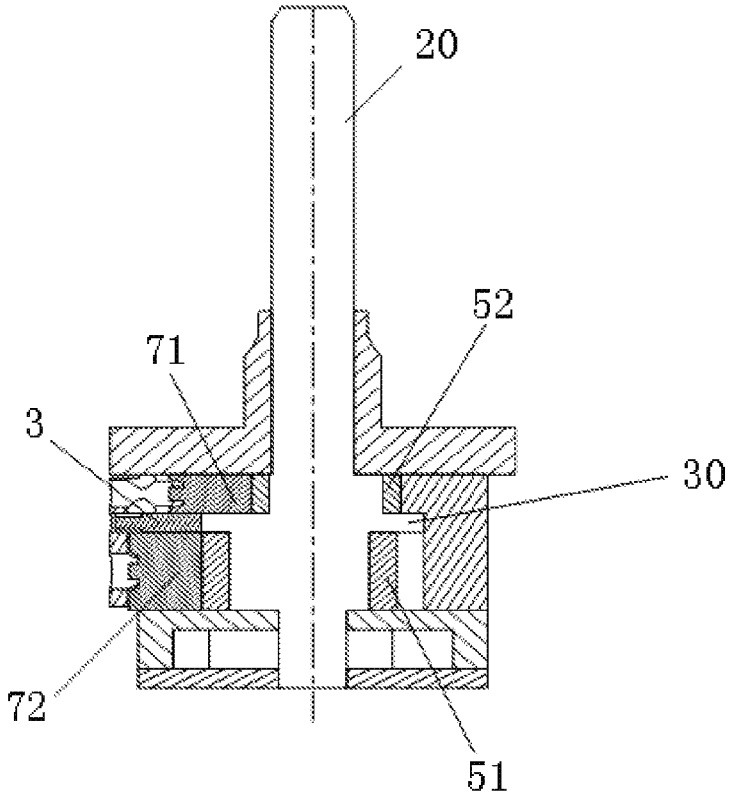
FIG. 16 is a cross-sectional view illustrating the pump body assembly of the present invention from another perspective.
Figure 17:
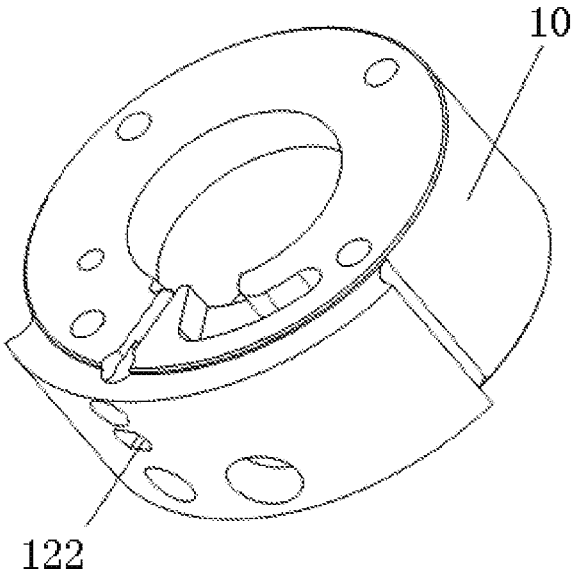
FIG. 17 is schematic structural view illustrating another embodiment of the cylinder of the present invention.
Figure 20:
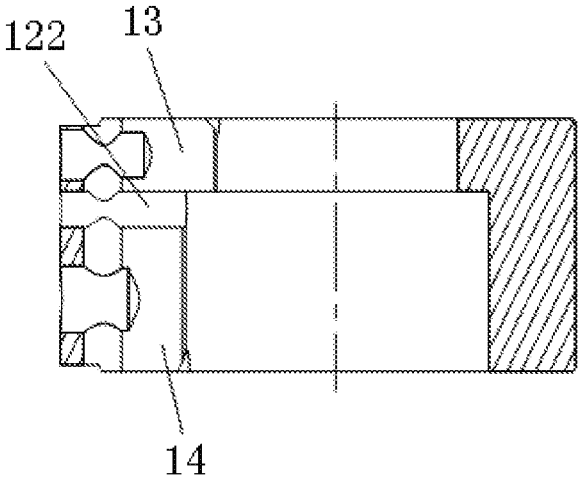
FIG. 20 is a cross-sectional view of FIG. 19 along the direction B-B.

When two eccentric portions are provided on the rotating shaft 20, the baffle 30 between the two eccentric portions separates the inner cavity of the cylinder 2 into two working cavities, and the two working cavities are an upper working cavity and a lower working cavity respectively. In this embodiment, the inner cavity of the cylinder 2 is a stepped hole. As shown in FIG. 16 and FIG. 20, the baffle 30 is lapped with the step portion of the stepped hole, separating the inner cavity of the cylinder into the upper working cavity and the lower working cavity with different diameters. It is not difficult to understand that in the drawings of the present invention, the diameter of the upper working cavity is less than the diameter of the lower working cavity, and of course, the diameter of the lower working cavity may be less than that of the upper working cavity.

Figure 18:
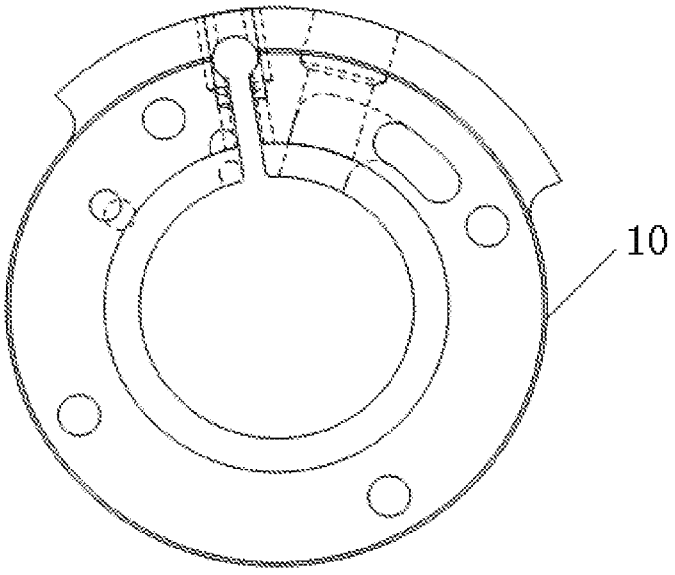
FIG. 18 is a bottom view of the cylinder in FIG. 17.
Figure 19:
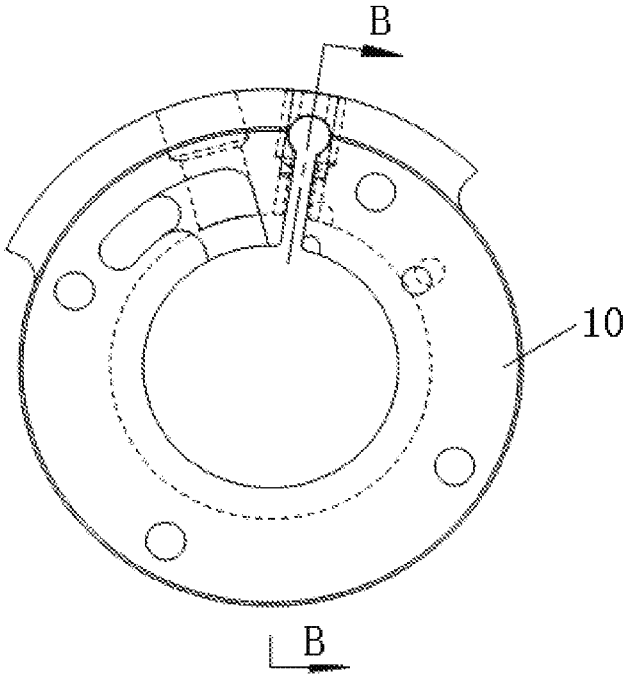
FIG. 19 is a top view of the cylinder in FIG. 17.

In this embodiment, the sliding vane groove in the upper working cavity and the sliding vane groove in the lower working cavity are connected to form an integral groove. As shown in FIG. 18 through FIG. 20, the side wall of the cylinder 2 is provided with a partition pin opening 122. A partition pin 3 is embedded in the partition pin opening 122 to separate the integral groove into the upper sliding vane groove 13 and the lower sliding vane groove 14. During the processing, the process opening in the rear portion of the sliding vane groove is punched first, for example, a longitudinal opening shown in FIG. 20. In order to ensure the processing precision of the sliding vane groove, linear cutting is performed first on the upper sliding vane groove 13 and the sliding vane groove 14, to cut through the sliding vane grooves of the two working cavities, and then process the partition pin opening 122. One end of the partition pin 3 extending into the inner cavity of the cylinder 2 is in sealing contact with the side wall of the baffle 30, to prevent leakage of gas refrigerant from the partition pin opening. As shown in FIG. 16, the upper surface and the lower surface of the partition pin 3 are in face sealing contact with the sliding vane 71 and the sliding vane 72 respectively, to prevent gas refrigerant from leaking from the sliding vane 71 and the sliding vane 72.

In order to further optimize the technical solutions in the above embodiments, in this embodiment, one end of the partition pin 3, which is in contact with the baffle 30, is a curved concave surface with a diameter equal to the diameter of the baffle 30, which enables the front end of the partition pin 3 to engage with and be attached to the baffle 30, thereby ensuring a more reliable sealing at the contact position.

Figure 21:
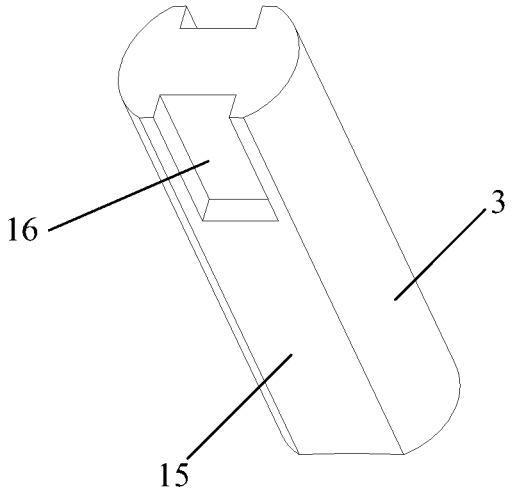
FIG. 21 is an overall schematic view of a partition pin according to an embodiment of the present invention.

As shown in FIG. 21, the partition pin 3 is a cylindrical pin body. In order to contact with the sliding vane 71 and the sliding vane 72 to form face sealing, the partition pin 3 has two oppositely disposed flat surfaces 15, which are configured to contact and be sealed with the sliding vanes to form face sealing. Further, in order to ensure a reliable stress between the partition pin 3 and the baffle 30, the partition pin 3 in this embodiment further includes a back pressure groove 16, which is disposed at a rear portion of the flat surface 15, and through which the stress can be exerted by back pressure gas inside the bump body housing of the compressor. Of course, the shape of the partition pin opening 122 should coincide with the cross-sectional shape of the partition pin 3.

It is to be noted that, in the embodiment of the present invention, one end of the partition pin 3, which extends into the inner cavity of the cylinder 2 and contacts with the baffle 30, is referred to as the front end, and the other end of the partition pin 3 is referred to as the rear end. On the premise that the seal of the sliding vane is ensured, the distance between the rear end of the partition pin 3 and the outer wall of the cylinder can be appropriately adjusted.

The present invention also discloses another form of partition pin 3, which is a quadrangular prismatic pin body. Since the pin body has flat surfaces, face sealing between the pin body and the sliding vane 71 and the sliding vane 72 can be achieved without processing flat surface. Similarly, in order to ensure a reliable and constant stress between the partition pin 3 and the baffle 30, the rear end of the partition pin 3 is further provided with a concave back pressure groove facing the inside of the cylinder 2.

In addition, the embodiment of the present invention further discloses a solution. In the solution, the inner cavity of the cylinder 2 is a through hole, and the side wall of the inner cavity of the cylinder 2 is provided with an annular groove configured to receive the baffle. The baffle 30 is embedded in the annular groove, to separate the inner cavity of the cylinder into an upper working cavity and a lower working cavity.

In the embodiment of the present invention, the gas inlet of each cylinder can be processed into a rectangular structure, a U-shaped structure, or a beveled cut, etc.; and the two working cavities separated by the baffle 30 can each have a separate gas inlet and a separate gas outlet, or since a relay compression for the gas refrigerant can be realized between the two working cavities, it is only required that the gas inlet of one working cavity is in communication with the gas outlet of the other working cavity. For the same reason, when more baffles 30 are provided, the plurality of working cavities can be independent from each other, or can be connected in series to realize multi-stage compression.

In the double-cylinder compressor shown in the figures of the present invention, the two cylinders are connected in series; the gas outlet of the lower working cavity is in communication with the gas inlet of the upper working cavity; and the lower working cavity is a low-pressure cavity, and the upper working cavity is a high-pressure cavity.

Wherein, the sliding vane 71 is an upper sliding vane; the sliding vane 72 is a lower sliding vane; the first roller 51 is a lower roller; the second roller 52 is an upper roller; the upper flange assembly includes an upper flange 75; and the lower flange assembly includes a lower flange 73.

The embodiment of the present invention further discloses a compressor, which includes a driving unit and a compressor pump body connected with the driving unit. The compressor pump body is the one disclosed by any one of the embodiments above. The drive unit of the compressor is usually a motor or a hydraulic motor.

The temperature adjusting device disclosed by the present invention is, but not limited to be, an air conditioner or a refrigerator, and the temperature adjusting device includes the compressor disclosed in the above embodiments.

Since both the compressor and the temperature adjusting device include the compressor pump body disclosed in the above embodiments, the compressor and the temperature adjusting device both have the corresponding technical advantages of the compressor body described above, which are not repeated herein.

The compressor, the compressor pump body and the temperature adjusting device provided by the present invention are described in detail. Specific examples are used to describe the principles and the embodiments of the present invention in the disclosure, and the descriptions of the above embodiments are only used to make the methods and the core idea of the present invention understood. It should be noted that, for those skilled in the art, various modifications and improvements can be made without departing from the principles of the present invention, and all these modifications and improvements are within the scope of the present invention.

In the above embodiments, the descriptions of various embodiments have different emphasis, and for the details which are not described in a certain embodiment, the related descriptions in other embodiments can be referred to.

What described above are preferred embodiments of the present invention, but not intended to limit the present invention. For those skilled in the art, various amendments and modifications can be made. Any modifications, equivalent substitutions and improvements made within the spirits and principles of the present invention are all within the scope of the present invention.

What is claimed is:

1. A pump body assembly, comprising a cylinder, a rotating shaft, and a baffle, wherein:

the cylinder comprises a cylinder body; a first cavity and a second cavity are disposed inside the cylinder body along an axial direction of the cylinder body; the first cavity is in communication with the second cavity; an inner diameter of the first cavity is greater than an inner diameter of the second cavity; and when the cylinder body is in operation, the first cavity forms a first working cavity; the second cavity forms a second working cavity;

the rotating shaft includes a first eccentric portion and a second eccentric portion, the first eccentric portion disposed in the first cavity of the cylinder body, and the second eccentric portion disposed in the second cavity of the cylinder body;

the baffle is arranged on the rotating shaft, and is disposed between the first eccentric portion and the second eccentric portion and located in the first cavity;

the baffle is configured to isolate the first cavity from the second cavity;

the baffle comprises a first plate body and a second plate body;

the first plate body includes a first curved recess and a receiving groove; and the second plate body includes a second curved recess; the second plate body includes a connecting convex portion at a side facing the first plate body; the second plate body is configured to engage with the first plate body; the first curved recess and the second curved recess define a shaft opening configured to receive a rotating shaft body; and the connecting convex portion is configured to be inserted into and engage with the receiving groove.

2. The pump body assembly according to claim 1, wherein, the baffle and the rotating shaft are integrally provided.

3. The pump body assembly according to claim 1, comprising:

a first roller disposed in the first cavity and sleeved on the first eccentric portion; and a second roller disposed in the second cavity and sleeved on the second eccentric portion.

4. The pump body assembly according to claim 3, wherein, a first sliding vane groove is disposed on a cavity wall of the first cavity; and a height of the first sliding vane groove is identical with a height of the first roller.

5. The pump body assembly according to claim 3, wherein, a second sliding vane groove is disposed on a cavity wall of the second cavity; and a height of the second sliding vane groove is identical with a height of the second cavity.

6. The pump body assembly according to claim 1, wherein, a first gas inlet and a first gas outlet, which are in communication with the first cavity, are disposed in a cavity wall of the first cavity; and a second gas inlet and a second gas outlet, which are in communication with the second cavity, are disposed in the cylinder body.

7. The pump body assembly according to claim 1, wherein, a first gas inlet and a first gas outlet, which are in communication with the first cavity, are disposed in a cavity wall of the first cavity; and a second gas inlet and a second gas outlet, which are in communication with the second cavity, are disposed in an end surface of the cylinder body; the second gas inlet is disposed in a cavity wall of the second cavity; and the second gas inlet is in communication with the first gas outlet.

8. The pump body assembly according to claim 7, wherein, an overflow passage is provided in the cylinder body; and the second gas inlet is connected to the first gas outlet through the overflow passage.

9. The pump body assembly according to claim 1, wherein, the first cavity and the second cavity are arranged coaxially, and an inner wall of the second cavity disposed above the first cavity forms a stopping portion.

10. A pump body assembly, comprising an upper flange, a lower flange, a cylinder, and a rotating shaft, wherein, two eccentric portions are disposed on the rotating shaft at a segment extending into an inner cavity of the cylinder; a baffle concentric with the rotating shaft is disposed between the two eccentric portions; the baffle configured to separate the inner cavity of the cylinder into two working cavities in one-to-one correspondence with said two eccentric portions;

the cylinder comprises a cylinder body; a first cavity and a second cavity are disposed inside the cylinder body along an axial direction of the cylinder body; the first cavity is in communication with the second cavity; an inner diameter of the first cavity is greater than an inner diameter of the second cavity; and when the cylinder body is in operation, the first cavity forms a first working cavity; the second cavity forms a second working cavity;

sliding vane grooves in the two working cavities are connected to form an integral groove; a side wall of the cylinder includes a partition pin opening; a partition pin is embedded in the partition pin opening and is configured to separate the integral groove; one end of the partition pin extending into the inner cavity of the cylinder contacts a side wall of the baffle and is sealed with the side wall of the baffle; and two side surfaces of the partition pin contact and are sealed with sliding vanes of said two working cavities respectively.

11. The pump body assembly according to claim 10, wherein, the one end of the partition pin, which is in contact with the baffle, is a curved concave surface with a diameter curvature equal to a diameter curvature of the side wall of the baffle.

12. The pump body assembly according to claim 10, wherein, the partition pin is a cylindrical pin body, which has two oppositely disposed flat surfaces; and said two flat surfaces are arranged to contact and to be sealed with the sliding vanes of said two working cavities.

13. The pump body assembly according to claim 12, wherein, the partition pin further comprises a back pressure groove, which is disposed at a rear portion of the flat surface, and through which a stress is exerted on the partition pin by back pressure gas.

14. The pump body assembly according to claim 10, wherein, the inner cavity of the cylinder (2) is a through hole, and a side wall of the inner cavity of the cylinder (2) is provided with an annular groove configured to receive the baffle; the baffle (30) is embedded in the annular groove, to separate the inner cavity of the cylinder (2) into said two working cavities.

15. The pump body assembly according to claim 10, wherein, the first cavity and the second cavity are arranged coaxially, and an inner wall of the second cavity disposed above the first cavity forms a stopping portion.

16. The pump body assembly according to claim 10, wherein, the partition pin is a quadrangular prismatic pin body; two oppositely disposed flat surfaces of the partition pin are arranged to contact and sealed with the sliding vanes of said two working cavities respectively.

17. The pump body assembly according to claim 16, further comprising a concave back pressure groove, which is disposed at a rear portion of the partition pin and facing inside of the cylinder.

18. The pump body assembly according to claim 10, wherein, each of said two working cavities has a separate gas inlet and a separate gas outlet.

19. The pump body assembly according to claim 10, wherein a gas inlet of one working cavity is in communication with a gas outlet of another working cavity.

* * * * *